US007859236B2

(12) United States Patent
Weng et al.

(10) Patent No.: US 7,859,236 B2
(45) Date of Patent: Dec. 28, 2010

(54) VOLTAGE REGULATION SYSTEM

(75) Inventors: Matthew Weng, San Ramon, CA (US); Charles Vinn, Milpitas, CA (US); Raymond David Zinn, Atherton, CA (US)

(73) Assignee: Micrel, Inc., San Jose, CA (US)

( * ) Notice: Subject to any disclaimer, the term of this patent is extended or adjusted under 35 U.S.C. 154(b) by 803 days.

(21) Appl. No.: 11/754,230

(22) Filed: May 25, 2007

(65) Prior Publication Data

US 2008/0290849 A1 Nov. 27, 2008

(51) Int. Cl.
*G05F 1/00* (2006.01)

(52) U.S. Cl. ..... 323/282

(58) Field of Classification Search ..... 323/265, 323/280–282

See application file for complete search history.

(56) References Cited

U.S. PATENT DOCUMENTS 5,912,552 A 6/1999 Tateishi
6,178,055 B1 1/2001 Janz
6,411,523 B1 6/2002 Nork et al.
6,445,623 B1 9/2002 Zhang et al.
6,566,852 B2 * 5/2003 Tagami et al. ..... 323/316
6,617,832 B1 9/2003 Kobayashi
7,109,692 B1 9/2006 Wu et al.
7,227,388 B2 * 6/2007 Weng et al. ..... 327/66
7,245,116 B2 * 7/2007 Tateno et al. ..... 323/316
7,304,464 B2 * 12/2007 Weng et al. ..... 323/285
7,471,071 B2 * 12/2008 Ng et al. ..... 323/273
7,495,420 B2 * 2/2009 Vinn ..... 323/266
2007/0114983 A1 * 5/2007 Weng et al. ..... 323/282

FOREIGN PATENT DOCUMENTS

EP 1801959 A3 6/2007
GB 2311629 A 10/1997

* cited by examiner

*Primary Examiner*—Adolf Berhane
*Assistant Examiner*—Yemane Mehari
(74) *Attorney, Agent, or Firm*—Mikio Ishimaru

(57) ABSTRACT

A voltage regulation system is provided including detecting a feedback voltage less than a reference voltage; asserting a current source gate output by the feedback voltage less than the reference voltage; activating a gated current source by the current source gate output; and waiting a delay interval before negating the current source gate output for turning off the gated current source.

16 Claims, 3 Drawing Sheets

VOLTAGE REGULATION SYSTEM

TECHNICAL FIELD

The present invention relates generally to power conditioning systems, and more particularly to a system for voltage regulation with enhanced transient response.

BACKGROUND ART

Switching regulators and linear regulators are well known types of voltage regulators for converting an unregulated voltage, such as a battery voltage, to a regulated DC voltage of a desired value. Some applications of voltage regulators include low noise DC-to-DC converter circuits for use in cell phones, PDA's (personal digital assistants), VCO (voltage controlled oscillator) and PLL (phase locked loop) power supplies, and smart card readers. One type of switching regulator is a pulse width modulation (PWM) regulator that turns a switching transistor on and off at a certain frequency. In a conventional buck regulator topology, the power supply voltage is intermittently coupled to an inductor, and the inductor conducts a triangular current waveform to recharge an output filter capacitor. The charged filter capacitor provides a relatively constant voltage to the load. A feedback signal, which is typically the output voltage, determines when to shut off the switching transistor during each switching cycle. The switch on-time percentage is called the duty cycle, and this duty cycle is regulated so as to provide a substantially constant voltage at the output despite load current changes. There are many types of switching regulators.

A linear regulator, also referred to as a low dropout (LDO) regulator, controls the conductance of a transistor in series between the unregulated power supply and the output terminal of the regulator. The conductance of the transistor is controlled based upon the feedback voltage to keep the output voltage at the desired level.

Switching regulators are generally considered to be more efficient than linear regulators since the switching transistor is either on or off. When a transistor is fully on, such as in saturation or near the edge of saturation, the transistor is a highly efficient switch, and there is a minimum of wasted power through the switch. However, due to the pulsing of the current through the switch, a relatively large size filter circuit, consisting of an inductor and a capacitor, is needed so as to provide a low-ripple regulated voltage at the output. The inductor must be sized to not saturate at the highest rated load current for the switching regulator under worst-case conditions. The size of the capacitor is based upon the frequency of the switching regulator and the allowable ripple. Accordingly, it is difficult to provide a very small switching regulator, including the filter circuitry, in a very small size while supplying a low-ripple regulated voltage.

A linear regulator, on the other hand, provides a very smooth output since the series transistor is always conducting. However, due to the large voltage differential across the transistor, power is wasted through the transistor, and substantial heat may be generated.

It is known to use a linear regulator at the output of a switching regulator to further smooth the output of the switching regulator for applications which require extremely steady regulated voltages. However, the resulting power supply is still relatively large due to the switching regulator inductor being sized so as not to saturate at the maximum load current under worst-case conditions. The size of the inductor and capacitor dominate the overall size of the regulator.

An additional issue that effects both linear and switching voltage regulators is the compensation needed on the feedback circuitry. The compensation is required to maintain stability in the regulation circuit, but it also limits the transient performance of those designs. Typical transient response for existing voltage regulator designs may be in the range of 10 to 100 μSec.

What is needed is a smaller size voltage regulator that supplies a very low amplitude ripple regulated output voltage with die size efficiency and shorter transient response times. In view of the ever-increasing commercial competitive pressures, along with growing consumer expectations and the diminishing opportunities for meaningful product differentiation in the marketplace, it is critical that answers be found for these problems. Additionally, the need to save costs, improve efficiencies and performance, and meet competitive pressures, adds an even greater urgency to the critical necessity for finding answers to these problems.

Solutions to these problems have been long sought but prior developments have not taught or suggested any solutions and, thus, solutions to these problems have long eluded those skilled in the art.

DISCLOSURE OF THE INVENTION

The present invention provides a voltage regulation system is provided including detecting a feedback voltage less than a reference voltage; asserting a current source gate output by the feedback voltage less than the reference voltage; activating a gated current source by the current source gate output; and waiting a delay interval before negating the current source gate output for turning off the gated current source.

Certain embodiments of the invention have other aspects in addition to or in place of those mentioned above. The aspects will become apparent to those skilled in the art from a reading of the following detailed description when taken with reference to the accompanying drawings.

BEST MODE FOR CARRYING OUT THE INVENTION

Figure 1:
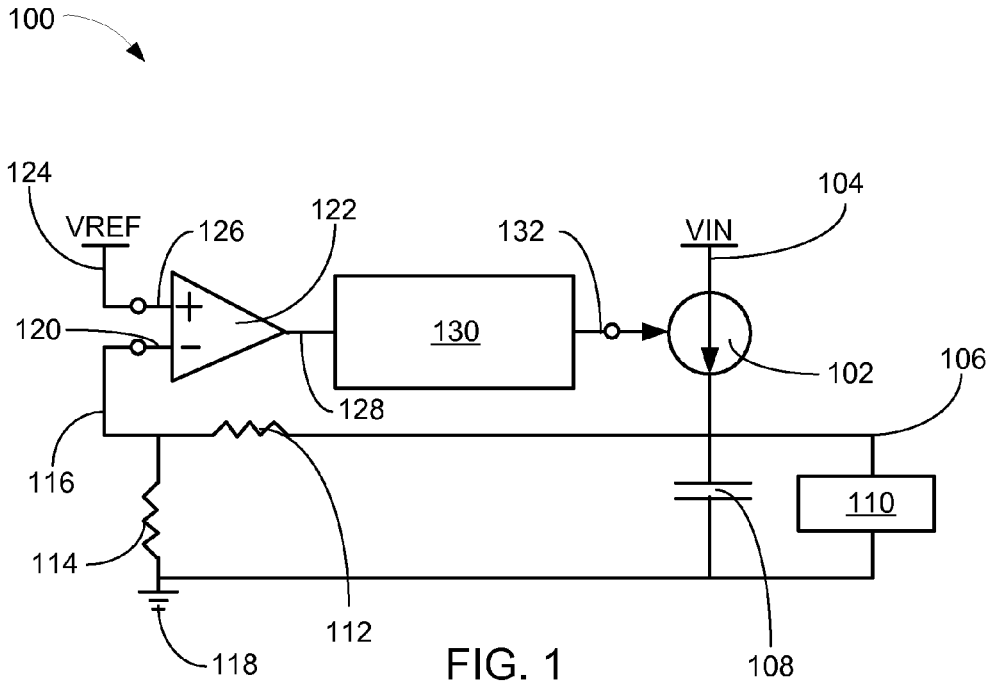
FIG. 1 is a block diagram of a voltage regulation system, in an embodiment of the present invention.

The following embodiments are described in sufficient detail to enable those skilled in the art to make and use the invention. It is to be understood that other embodiments would be evident based on the present disclosure, and that process or mechanical changes may be made without departing from the scope of the present invention.

In the following description, numerous specific details are given to provide a thorough understanding of the invention. However, it will be apparent that the invention may be practiced without these specific details. In order to avoid obscuring the present invention, some well-known circuits, system configurations, and process steps are not disclosed in detail.

Likewise, the drawings showing embodiments of the system are semi-diagrammatic and not to scale and, particularly, some of the dimensions are for the clarity of presentation and are shown greatly exaggerated in the drawing FIGs. Where multiple embodiments are disclosed and described, having some features in common, for clarity and ease of illustration, description, and comprehension thereof, similar and like features one to another will ordinarily be described with like reference numerals.

For expository purposes, the term "on" means there is direct contact among elements. The term "system" as used herein means and refers to the method and to the apparatus of the present invention in accordance with the context in which the term is used.

Referring now to FIG. 1, therein is shown a block diagram of a voltage regulation system 100, in an embodiment of the present invention. The block diagram of the voltage regulation system 100 depicts a gated current source 102, having a first conductor 104 for supplying a voltage input (VIN) and a second conductor 106. An output capacitor 108, a load 110 and a feedback resistor 112 are coupled to the second conductor 106. A bias resistor 114 is coupled between a third conductor 116 and a ground connection 118 for scaling a feedback voltage (FB). The third conductor 116, which carries the feedback voltage (FB), is coupled to a negative input 120 of an operational amplifier 122. A fourth conductor 124, for supplying a voltage reference (VREF), is coupled to a positive input 126 of the operational amplifier 122. A current source on signal (CSON) 128, output from the operational amplifier 122, is coupled to a delayed turn-off circuit 130. The delayed turn-off circuit 130 has a current source gate output 132 that may activate the gated current source 102.

During the operation of the load 110, the current is sourced from the output capacitor 108 until the feedback voltage at the third conductor 116 is reduced below the voltage reference present on the positive input 126 of the operational amplifier 122. When this condition occurs, the current source on signal 128 is immediately turned on and the gated current source 102 is immediately activated. While the gated current source 102 is activated, it sources the current used by the load 110 and the current flowing into the output capacitor 108. When the voltage of the output capacitor 108 is once again raised to the proper level, the feedback voltage is raised above the reference voltage and the current source on signal 128 is negated.

The gated current source 102 remains activated due to the delayed turn-off circuit 130, which may be programmed for a delay interval $\tau$. The programming of the interval $\tau$ may be performed by a processor in the design or it may be fixed by the design of a standard delay element for a specific application.

Figure 2:
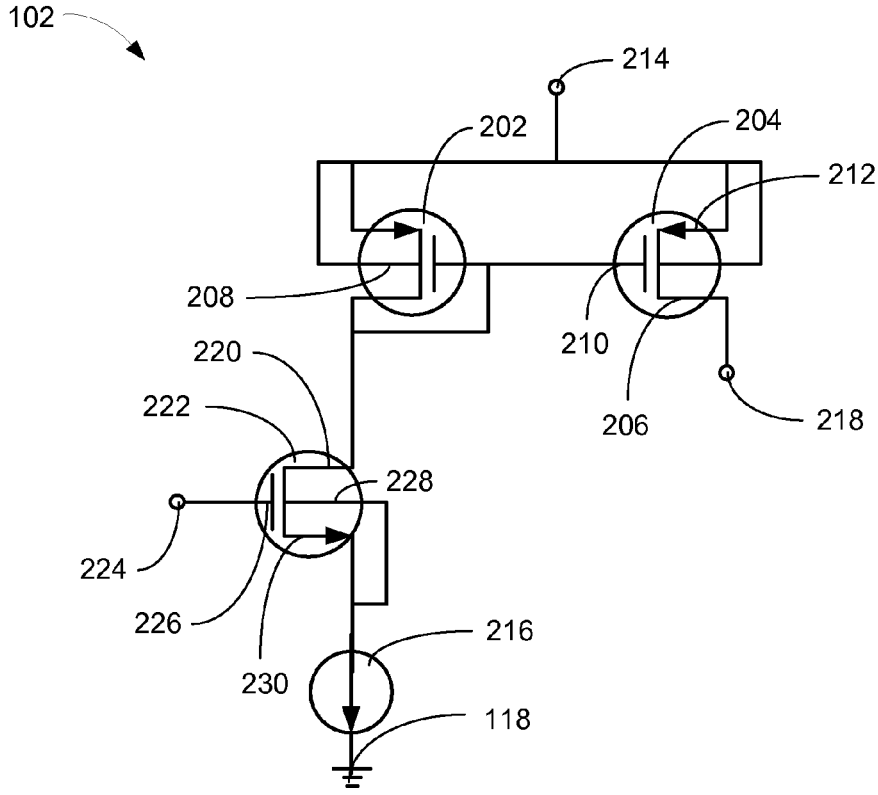
FIG. 2 is a schematic diagram of an embodiment of the gated current source of FIG. 1.

Referring now to FIG. 2, therein is shown a schematic diagram of an embodiment of the gated current source 102 of FIG. 1. The schematic diagram depicts a first transistor 202, such as an P-channel Metal Oxide Semiconductor Field Effect Transistor (MOSFET), a P-channel Junction Field Effect Transistor (JFET), or an P-N-P Bipolar Junction Transistor (BJT), coupled in a current mirror configuration with a second transistor 204 of the same type as the first transistor 202. The first transistor 202 and the second transistor 204 have a P-drain 206, a P-body tie 208, a first gate 210 and a P-source 212. The P-body tie 208 and the P-source 212, of each transistor, may be coupled to a voltage node 214. The first gate 210 of the first transistor 202 is coupled to the first gate 210 of the second transistor 204, the P-drain 206 of the first transistor 202 and an N-drain 220. The P-drain 206 of the second transistor 204 may be coupled to a current node 218, for attaching the load 110 of FIG. 1.

A switch transistor 222, such as an N-channel Metal Oxide Semiconductor Field Effect Transistor (MOSFET), an N-channel Junction Field Effect Transistor (JFET), or an N-P-N Bipolar Junction Transistor (BJT) may enable or disable a current source 216. An activation node 224 may be coupled to a second gate 226 of the switch transistor 222. An N-source 228 and an N-body tie 230 may be coupled to the current source 216 which may be coupled to the ground connection 118.

When the activation node 224 is asserted, the switch transistor 222 conducts the current through the first transistor 202 and the current source 216. The amount of current that flows is dependent on the value of the current source 216, such as a 600 milliamp version of the current source 216. The same value of current may flow through the second transistor 204 when the load 110 of FIG. 1 is connected. The operation of the second transistor 204 allows a current limit of the voltage regulation system 100 of FIG. 1 without the requirement of additional circuitry. If the activation node 214 is negated, no current is allowed to flow through the first transistor 202 or the second transistor 204.

Figure 3:
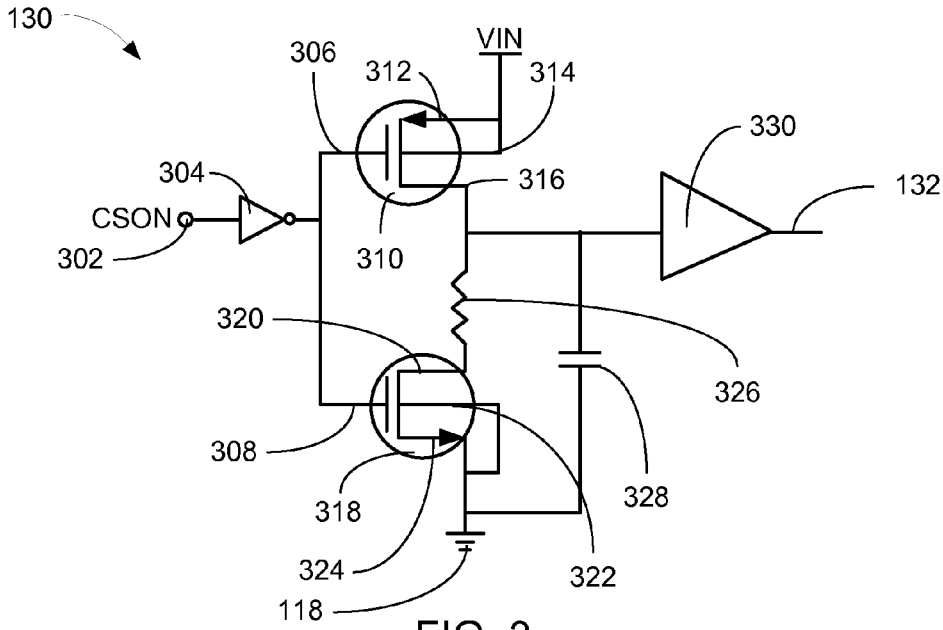
FIG. 3 is a functional block diagram of the delayed turn-off circuit of FIG. 1, in an embodiment of the present invention.

Referring now to FIG. 3, therein is shown a functional block diagram of the delayed turn-off circuit 130 of FIG. 1, in an embodiment of the present invention. The functional block diagram of the delayed turn-off circuit 130 depicts a node (CSON) 302 coupled to a first inverter 304. The output of the inverter 304 is coupled to a first gate 306 and a second gate 308. The first gate 306 is part of a first delay interval transistor 310, such as P-channel transistor, having a P-source 312, a P-body tie 314, and a P-drain 316. The second gate 308 is part of a second delay interval transistor 318, such as an N-channel transistor, having an N-drain 320, an N-body tie 322, and an N-source 324.

The P-drain 316 is coupled to a first end of a resistor 326, the first end of a delay capacitor 328 and the input of a hysteretic buffer 330. The second end of the resistor 326 may be connected to the N-drain 320. The second end of the delay capacitor 328 may be coupled to the ground terminal 118, the N-body tie 322, and the N-source 324. The hysteretic buffer 330 has an input circuit that applies hysteresis to the input signal, such that the output of the buffer does not oscillate when the input signal reaches a critical threshold.

When the node (CSON) 302 is asserted, the first gate 306 is activated and the second gate 308 is negated. This action turns on the first delay interval transistor 310 and turns off the second delay interval transistor 318. With the first delay interval transistor 310 turned on, the current source gate output 132 is immediately asserted. The delay capacitor 328 will store charge to reflect the voltage on the input of the hysteretic buffer 330.

When the node (CSON) 302 is negated, the first gate 306 is negated and the second gate 308 is activated. This action turns off the first delay interval transistor 310 and turns on the second delay interval transistor 318. With the first delay interval transistor 310 turned off, the input of the hysteretic buffer 330 remains on due to the charge stored in the delay capacitor 328. The delay capacitor 328 will discharge through the resistor 326 and the second delay interval transistor 318. The hysteretic buffer 330 will hold the current source gate output 132 active until the delay capacitor 328 discharges below the threshold of the hysteresis applied to the input of the hysteretic buffer 330.

A delay interval $\tau$ may include the propagation delay of the inverter 304, the hysteretic buffer 330, and the operational amplifier 122, of FIG. 1. It may also include the switching delay of the first delay interval transistor 310, the second delay interval transistor 318, and the gated current source 102, of FIG. 1. By way of an example a typical range of the delay interval τ is 80-100 ηSec. As compared to the typical transient response times of linear and switching voltage regulators, that may be in the range of 10 to 100 μSec, the transient response of the current invention is dramatically faster. The transient response performance is enabled by the architecture of the current invention.

It is understood that this embodiment of the delayed turn-off circuit 130 is for example only and it may be implemented in many different ways. The duration of the delay interval τ may be implemented as a fixed or programmable delay based on the application supported.

Figure 4:
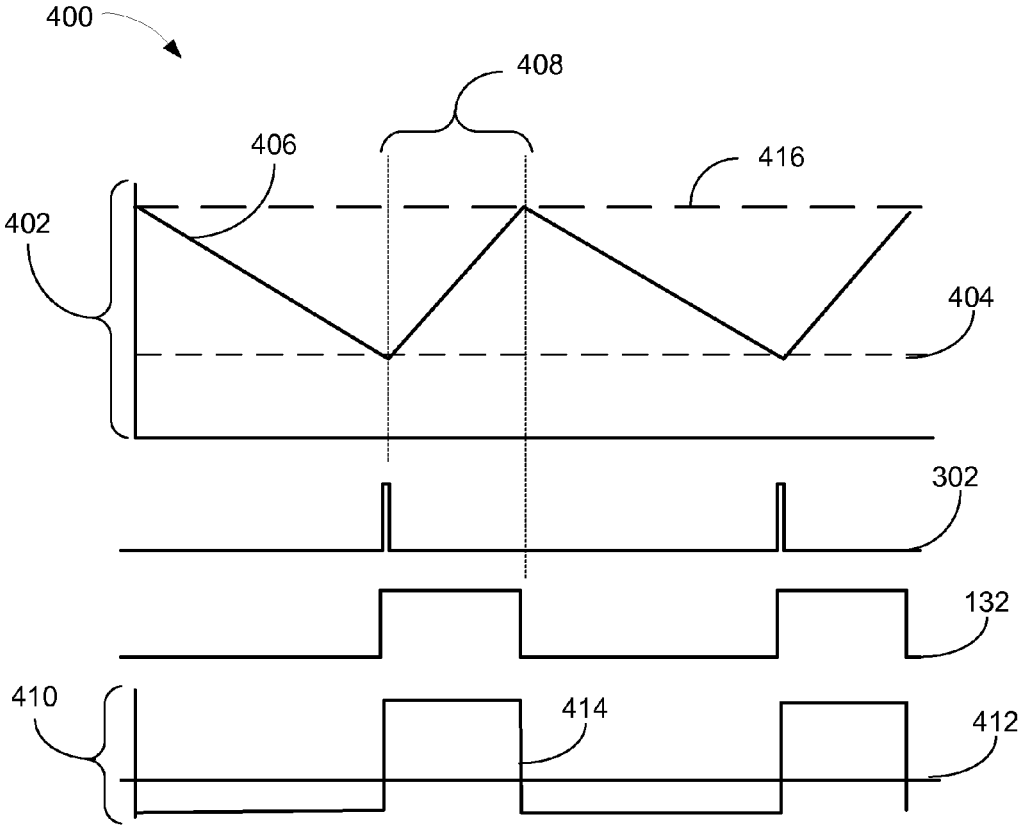
FIG. 4 is a timing diagram of the operation of the voltage regulation system of the present invention.

Referring now to FIG. 4, therein is shown a timing diagram of the operation of the voltage regulation system 100 of the present invention. The timing diagram of the operation of the voltage regulation system 100 depicts a feedback voltage waveform 402 having a horizontal axis of time (T) and a vertical axis of volts (V). A voltage reference line (VREF) 404 is the trigger for activating the voltage regulation system 100. A feedback voltage 406 displays a decreasing voltage until the voltage reference line 404 is encountered. The current source on node 302 is displayed beneath the feedback voltage waveform 402. When the feedback voltage 406 drops to the voltage reference line 404, the current source on node 302 is activated causing the gated current source 102 of FIG. 1 to conduct current into the load 110 of FIG. 1 and the output capacitor 108 of FIG. 1.

The current source gate output 132 is activated by the assertion of the current source on node 302 and is extended by the delayed turn-off circuit 130 of FIG. 1. A delay interval (τ) 408 allows the gated current source 102 to stabilize the circuit. While the current source gate output 132 is asserted the gated current source 102 sources the current required to operate the load 110 and charge the output capacitor 108. At the end of the delay interval 408 the gated current source 102 is gated off and the output capacitor 108 sources the current for the load 110. This is demonstrated in a current waveform 410 having a neutral current line 412 and a current plot 414. The regions having the current plot 414 above the neutral current line 412 are driven by the gated current source 102 to charge the output capacitor 108 up to a peak voltage 416. The regions having the current plot 414 below the neutral current line 412 represent the output capacitor 108 discharging current into the load 110. As the current in the capacitor is depleted, the voltage drops until the feedback voltage 406 once again reaches the voltage reference line 404 and the cycle repeats.

The peak to peak voltage ripple produced by the voltage regulation system 100 may be calculated by equation 1:

$$V_{ripple} = \frac{Isource - Iload}{Cout} * \tau \quad (1)$$

By way of an example, a voltage regulation system 100 may source 600 mAmps to a load that requires 300 mAmps and has a 10 μF output capacitor and a delay interval τ of 100 ηSec. The resultant peak to peak voltage ripple may be calculated using equation 1 as follows:

$$V_{ripple} = \frac{600\,\text{mA} - 300\,\text{mA}}{10\,\mu\text{F}} * 100\,\eta\text{Sec} = 3\,\text{mV}$$

If less ripple voltage is required for the operation of the circuit load, a shorter delay interval τ may be implemented. If the delay interval is reduced to 80 ηSec, the resulting peak to peak ripple voltage may be 2.4 mV.

Figure 5:
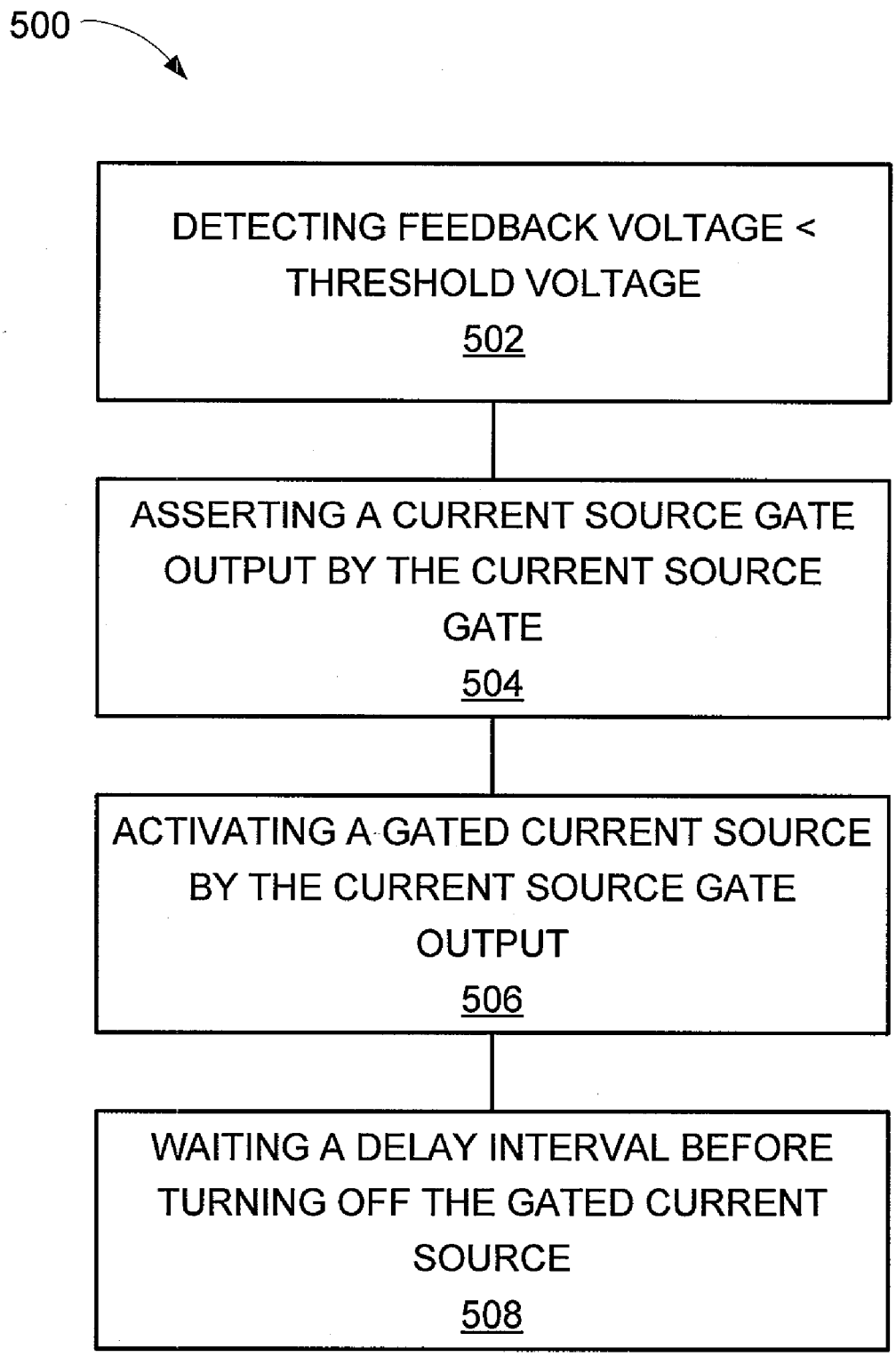
FIG. 5 is a flow chart of a voltage regulation system for operating a voltage regulation system in an embodiment of the present invention.

Referring now to FIG. 5, therein is shown a flow chart of a voltage regulation system 500 for operating a voltage regulation system in an embodiment of the present invention. The system 500 includes detecting a feedback voltage less than a threshold voltage in a block 502; asserting a current source gate output by the feedback voltage less than the threshold voltage in a block 504; activating a gated current source by the current source gate output in a block 506; and waiting a delay interval before negating the current source gate output for turning off the gated current source in a block 508.

In greater detail, a system to operate the voltage regulation system, according to an embodiment of the present invention, is performed as follows:

1. Detecting a feedback voltage less than a threshold voltage by monitoring an operational amplifier. (FIG. 1)
2. Asserting a current source gate output by the feedback voltage less than the threshold voltage. (FIG. 1)
3. Activating a gated current source by the current source gate output includes enabling a switch transistor. (FIG. 2) and
4. Waiting a delay interval before negating the current source gate output for turning off the gated current source including charging an output capacitor. (FIG. 1)

An aspect of an embodiment of the present invention is that it reduces the cost of manufacturing voltage regulators, with low ripple, within an integrated circuit. The implementation of the gated current source allows a single current source to set the maximum current for the voltage regulator without additional circuitry. The predetermined delay in turning off the current source allows a precise amount of ripple to be determined at the beginning of the design cycle. The architecture of the current invention provides the fastest possible response time for a given technology because no compensation capacitor is required to slow the feedback response.

Yet another important aspect of the present invention is that it valuably supports and services the historical trend of reducing costs, simplifying systems, and increasing performance.

These and other valuable aspects of the present invention consequently further the state of the technology to at least the next level.

Thus, it has been discovered that the voltage regulation system of the present invention furnishes important and heretofore unknown and unavailable solutions, capabilities, and functional aspects for manufacturing integrated circuits having high quality voltage regulators in a very small space. The resulting processes and configurations are straightforward, cost-effective, uncomplicated, highly versatile and effective, can be surprisingly and unobviously implemented by adapting known technologies, and are thus readily suited for efficiently and economically manufacturing voltage regulation devices fully compatible with conventional manufacturing processes and technologies. The resulting processes and configurations are straightforward, cost-effective, uncomplicated, highly versatile, accurate, sensitive, and effective, and can be implemented by adapting known components for ready, efficient, and economical manufacturing, application, and utilization.

While the invention has been described in conjunction with a specific best mode, it is to be understood that many alternatives, modifications, and variations will be apparent to those skilled in the art in light of the aforegoing description. Accordingly, it is intended to embrace all such alternatives, modifications, and variations that fall within the scope of the included claims. All matters hithertofore set forth herein or shown in the accompanying drawings are to be interpreted in an illustrative and non-limiting sense.

What is claimed is:

1. A method of operating a voltage regulation system comprising:

detecting a feedback voltage less than a threshold voltage;

asserting a current source gate output by the feedback voltage less than the threshold voltage;

activating a gated current source by the current source gate output; and waiting a delay interval before negating the current source gate output for turning off the gated current source by:

activating a second delay interval transistor, discharging a delay capacitor through the second delay interval transistor, and detecting the delay capacitor discharged for negating the current source gate output.

2. The method as claimed in claim 1 wherein activating the gated current source includes sourcing a current from a current mirror.

3. The method as claimed in claim 1 wherein asserting the current source gate output includes:

monitoring an operational amplifier; and activating a first delay interval transistor by the operational amplifier.

4. The method as claimed in claim 1 further comprising charging an output capacitor through the gated current source by activating the current source gate output.

5. A method of operating a voltage regulation system comprising:

detecting a feedback voltage less than a threshold voltage by monitoring an operational amplifier;

asserting a current source gate output by the feedback voltage less than the threshold voltage;

activating a gated current source by the current source gate output includes enabling a switch transistor; and waiting a delay interval before negating the current source gate output for turning off the gated current source including charging an output capacitor by:

activating a second delay interval transistor;

discharging a delay capacitor through the second delay interval transistor includes discharging the delay capacitor through a resistor; and detecting the delay capacitor discharged for negating the current source gate output includes sourcing the current source gate output by a hysteretic buffer.

6. The method as claimed in claim 5 wherein activating the gated current source includes sourcing a current from a current mirror having a first transistor and a second transistor in which configuring the current mirror includes establishing a current limit by a current set resistor.

7. The method as claimed in claim 5 wherein asserting the current source gate output includes:

monitoring the operational amplifier for activating a current source on signal; and activating a first delay interval transistor by the operational amplifier including charging a delay capacitor.

8. The method as claimed in claim 5 further comprising charging an output capacitor through the gated current source by activating the current source gate output including limiting a peak voltage.

9. A voltage regulation system comprising:

an operational amplifier for detecting a feedback voltage less than a threshold voltage;

a current source gate output from the operational amplifier;

a gated current source coupled to the current source gate output; and a delay turn-off circuit for turning off the gated current source includes:

a second delay interval transistor, a resistor coupled to the second delay interval transistor, a delay capacitor coupled to the resistor, and a hysteretic buffer coupled to the resistor and the delay capacitor.

10. The system as claimed in claim 9 further comprising a current mirror, in the gated current source, configured with a first transistor and a second transistor.

11. The system as claimed in claim 9 wherein the delay turn-off circuit includes:

the operational amplifier for monitoring the feedback voltage; and a first delay interval transistor coupled to the operational amplifier.

12. The system as claimed in claim 9 further comprising an output capacitor for storing a current from a second transistor of the gated current source.

13. The system as claimed in claim 9 further comprising:

a switch transistor in the gated current source; and an output capacitor coupled to the gated current source for charging the output capacitor by the switch transistor activated.

14. The system as claimed in claim 13 further comprising a current mirror, in the gated current source, configured with a first gate of a first transistor coupled to the first gate of a second transistor.

15. The system as claimed in claim 13 further comprising:

a feedback resistor coupled to the output capacitor; and a bias resistor coupled to the feedback resistor for scaling the feedback voltage from the output capacitor.

16. The system as claimed in claim 13 further comprising a current source coupled to the first gate of a first transistor and a second transistor in which the first transistor is coupled through the current source and the second transistor is coupled to a load.

* * * * *